US006777884B1

(12) United States Patent
Barnardo et al.

(10) Patent No.: US 6,777,884 B1
(45) Date of Patent: Aug. 17, 2004

(54) ELECTROLUMINESCENT DEVICES

(75) Inventors: Christopher J. A. Barnardo, Bishops Stortford (GB); Christopher J. N. Fryer, Cottenham (GB); Christopher Davies, Cambridgeshire (GB); Paul Cox, Swavesey (GB)

(73) Assignee: Pelikon Limited, Caerphilly (GB)

( * ) Notice: Subject to any disclaimer, the term of this patent is extended or adjusted under 35 U.S.C. 154(b) by 0 days.

(21) Appl. No.: 09/673,819

(22) PCT Filed: Apr. 22, 1999

(86) PCT No.: PCT/GB99/01233

§ 371 (c)(1),
(2), (4) Date: Jan. 5, 2001

(87) PCT Pub. No.: WO99/55121

PCT Pub. Date: Oct. 28, 1999

(30) Foreign Application Priority Data

Apr. 22, 1998 (EP) ..... 98303084
Apr. 22, 1998 (EP) ..... 98303085

(51) Int. Cl.[7] ..... G09G 3/10
(52) U.S. Cl. ..... 315/169.1; 315/169.3; 345/76
(58) Field of Search ..... 315/169.1, 169.3; 368/226, 67, 227, 68; 438/106, 22–24; 313/483; 345/76

(56) References Cited

U.S. PATENT DOCUMENTS 4,748,366 A 5/1988 Taylor ..... 310/328
5,220,249 A 6/1993 Tsukada ..... 315/246
5,334,539 A 8/1994 Shinar et al. ..... 437/1
5,449,970 A * 9/1995 Kumar et al. ..... 313/495
5,463,279 A 10/1995 Khormaei ..... 315/169.3
5,504,390 A 4/1996 Topp ..... 313/509
5,598,382 A * 1/1997 Wilson et al. ..... 368/226
5,686,792 A 11/1997 Ensign, Jr. ..... 313/509
5,691,962 A * 11/1997 Schwartz et al. ..... 368/71
5,757,128 A 5/1998 Topp ..... 313/509
6,118,426 A * 9/2000 Albert et al. ..... 245/107
6,242,076 B1 * 6/2001 Andriash ..... 428/138
6,370,019 B1 * 4/2002 Matthies et al. ..... 361/681
6,541,919 B1 * 4/2003 Roach et al. ..... 315/169.3
6,590,346 B1 * 7/2003 Hadley et al. ..... 315/169.3

FOREIGN PATENT DOCUMENTS

DE 25 55 014 A 6/1976

* cited by examiner

*Primary Examiner*—James Clinger
*Assistant Examiner*—Jimmy T. Vu
(74) *Attorney, Agent, or Firm*—Alix, Yale & Ristas, LLP

(57) ABSTRACT

An electroluminescent lamp or display comprises a first electrode on a substrate interdigitated with a second electrode on the same substrate. A layer of electroluminescent material is provided over the electrodes. The arrangement has the advantage that light from the electroluminescent material does not need to pass through either of the electrodes. The substrate may be a printed circuit board. In an alternative embodiment the second electrode is provided over the layer of electroluminescent material and gaps are provided in the electrode for the emission for light. The electroluminescent lamps may be used to form a seven-segment display.

8 Claims, 2 Drawing Sheets

ELECTROLUMINESCENT DEVICES

CROSS-REFERENCE TO RELATED APPLICATION

This is the U.S. national phase of International Application No. PCT/GB99/01233 filed Apr. 22, 1999.

1. Field of the Invention

The present invention relates to electroluminescent (EL) devices, in particular to electroluminescent displays.

2. Background Art

Electroluminescence is the emission of light from a substance under electric-field excitation.

Phosphor electroluminescence was discovered and documented in 1936, but it was not until the 1950's that GTE Sylvania received a patent for an EL powder lamp. However, the short lifetimes (around 500 hrs) of such devices limited their use. Work carried out in the 1980's revitalised the powder EL lamp and in 1990 the Durel Corporation demonstrated a flexible EL phosphor device that was incorporated into a LCD flat panel display as a backlight. The manufacturing technique involved encapsulating the phosphor powder particles in glass beads and sandwiching the powder, which is held in a dielectric matrix, between two electrodes. An AC voltage was applied to the electrodes to stimulate emission. In this way, the thick film phosphor lamp was made a commercial reality.

A typical, known thick-film (or powder) phosphor EL device is shown in FIG. 1 and comprises a light emitting material 3 in a dielectric matrix 5, sandwiched between two conducting electrodes 1, 6. The light emitting component (the 'emitter') is phosphor, typically a zinc sulphide (ZnS) powder doped with manganese (Mn). Typically, silver- (Ag), or graphite-loaded screen-printable inks, and indium tin oxide (ITO), which is a transparent conductive material, are used as the electrodes. When an AC voltage is applied between the electrodes, the emitter breaks down and conducts current. The current excites the manganese ions, which give off light.

It is known to construct lamps from EL material. The benefits of phosphor EL lamps are that they can be made very thin (<0.3 mm); they are flat, fully flexible when applied to a flexible plastics substrate; they are rugged, have a wide viewing angle, can be made quite cheaply, can be made in low volumes using simple techniques, and give off very little heat when emitting light. Typically, EL lamps are used for backlighting LCD displays (e.g. watches, mobile phones, etc.) and instrument panels.

It is also known to reduce moisture ingression into EL lamps, which would otherwise degrade the ZnS and greatly reduce the service life of the device, by the technique of microencapsulation, where the individual phosphor particles 3 are coated in glass or ITO 4.

Phosphor EL lamps can be dc-driven by low voltage circuits (1.5–5V) by using inverters and inductors generating AC voltages of, for example, 100 to 300V (peak to peak) at frequencies of 50 to 10,000 Hz. These EL devices can generate luminances of 10–100 cd/m$^2$. Specific lamp/driver arrangements will deliver a lamp half-life of between 3,500 and 10,000 hrs. EL lamps are used when an application indicates a need for soft, uniform light emission with a wide viewing angle, operating over a wide temperature range (−40° C. to +70° C.), with vibration and shock resistance.

In the recent development and commercialisation of the phosphor EL lamp, much effort has been applied to making brighter phosphors which emit more even light and which have extended usable lifetimes. In many cases this has led to refinement of the drive strategies to find a match of drive frequency with voltage.

Most recently, the market for EL lamps has increased as they have become more widely available with the declining cost of the components (specifically the ITO coated polyester substrate), and with an increasing awareness of EL lamps amongst industrial designers. Their use for LCD backlighting has led to the proliferation of these devices, but newer markets of automotive dashboard lighting and white goods keypad lighting look certain to make the phosphor EL lamp a real mass market component in the future.

Known EL lamps require a transparent conductor through which light is emitted.

Although a range of alternative transparent conductors have been tried (including, transparent conductive polymers and screen printed ITO), at present there appears to be no alternative to the ITO coated substrate. This transparent conductor must be coated onto a transparent substrate using a proprietary process and this is an expensive part of the device (accounting for up to 50% of the production cost).

Apart from expense, there are other problems relating to the use of a transparent electrode coating:

In order to get fine resolution in a prior art lamp used as a display, areas of the ITO conduction layer must be removed to produce an electrode pattern using either laser oblation or an etching process, further adding to the cost of manufacture.

The need for a transparent substrate and transparent conductor limits the application possibilities.

The ITO is not a good conductor and therefore requires high current densities to enable such a device to function acceptably.

Using two different processes to create the top and bottom electrodes creates registration. difficulties, which become critical when fine resolution devices are manufactured.

The present invention at least in its preferred embodiments aims to provide an EL lamp or display which overcomes at least some of the drawbacks of prior art EL lamps and displays.

The present invention at least in its preferred embodiments further aims to provide an EL lamp or display which does not require the use of a transparent electrode and which is relatively easy and cheap to produce.

SUMMARY OF THE INVENTION

Viewed from a first aspect, the present invention provides an electroluminescent illuminating means comprising an electroluminescent substance having at least one surface from which light emission is intended and a plurality of electrodes positioned substantially parallel to the surface(s) of the electroluminescent substance from which light emission is intended so as to cause, in use, an appropriate field of radiation in the electroluminescent substance, wherein at least a portion of at least one of the surfaces of the electroluminescent substance from which light emission is intended is not covered by any of the plurality of electrodes whereby intended light emission does not need to pass through the material of an electrode.

The invention elegantly solves the problem of creating a simpler and cheaper EL lamp or display by obviating the need for expensive transparent conductors such as ITO.

The invention also eliminates the need for a laminated electrode structure incorporating a transparent conductor as one of the lamina.

The electroluminescent illuminating means may be incorporated in an electroluminescent device such as an EL lamp. In a preferred arrangement, however, the electroluminescent illuminating means is incorporated into an electroluminescent display device. An electroluminescent display device will generally comprise at least one region, for example a layer, of electroluminescent material arranged between at least one primary electrode and a plurality of secondary electrodes, wherein the secondary electrodes are arranged to be selectively electrically energised to cause selected portions of said electroluminescent material to illuminate, and thereby convey information.

Viewed from a second aspect therefore, the invention provides an electroluminescent display device comprising at least one region of electroluminescent material arranged between at least one primary electrode and a plurality of secondary electrodes, wherein the secondary electrodes are arranged to be selectively electrically energised to cause selected portions of said electroluminescent material to illuminate, and thereby convey information. The device preferably comprises electroluminescent material in the form of a powdered phosphor in a dielectric carrier, for example a microencapsulated phosphor, also known as a thick-film EL phosphor.

The primary and/or secondary electrode may be formed on a printed circuit board, for example at the same time as the conductive tracks are applied to the PCB substrate. The region of electroluminescent material may also then be formed on the PCB substrate and further electrodes applied as necessary. In this way an electroluminescent device may be formed integrally with a printed circuit board in order to achieve a particularly convenient electronically-controlled illumination device or illuminated display, for example.

Viewed from a third aspect therefore the invention provides an electroluminescent device comprising an electroluminescent material arranged between two electrodes wherein at least one of said electrodes is formed as a conductive track on a printed circuit board. As explained above, both electrodes may be formed as conductive tracks on a printed circuit board. The printed circuit board may comprise additional electronic components for controlling the electroluminescent device. This invention extends to a method of making an electroluminescent device as described above.

In a particularly convenient arrangement, the portions of electroluminescent material are arranged in the form of a segmented display, such as a seven segment display.

Segmented displays per se are known. Typically, segmented displays are used as alpha-numeric displays where segmented blocks are arranged in arrays so that it is possible to display individual characters with the minimum of addressable areas. The seven segment display, shown for example in FIG. 4, is an example of such a display which uses a small number of addressable areas and which can be used to display the Arabic numeral set. Such seven segment displays are widely used in almost every application where numerical display is necessary.

In the prior art the segments of such a display are made up of light emitting diodes (LEDs) or addressable liquid crystal (LC) areas.

In the case of LED displays, the display is constructed by positioning and fixing a number of diodes (typically, within a plastic moulding) and connecting them to a controlled power supply, so that each may be lit 9 or unlit 10 (see FIG. 4). Alphanumeric characters are displayed by lighting certain patterns of diodes.

In the case of the LC material the segmented areas use the liquid crystal's nematic phase change properties, coupled with a polarising layer, to alter the light transmission quality of a designated area of the display. The display is backlit either by reflected incident light, transmitted light or by an artificial light source placed behind the display area. Alphanumeric characters are displayed by the contrast between the light and dark areas of the display.

Drawbacks of prior art segmented addressable displays include:

LEDs or other lamps are expensive to make.

It is expensive to locate LEDs and other lamps within a plastic moulding.

LEDs do not give high resolution and so limit the size of the characters of an alphanumeric display LCDs are expensive because they have sensitive production processes that demand a high level of precision and they require glass substrates. This expense means that the production of such displays is only commercially viable at mass production volumes.

LCDs have a narrow viewing angle as a result of their nematic mode of operation.

LCDs need to be backlit for dark field applications.

LCDs often need to be driven actively. Viewed from a fourth aspect, the present invention provides an addressable segmented display which comprises a plurality of phosphor electroluminescent lamps arranged in a predetermined layout.

The invention elegantly solves the problem of creating a segmented addressable display which is cheap to produce and which does not require backlighting.

The invention at least in its preferred embodiments provides a passively driven segmented display which overcomes at least some of the drawbacks of prior art segmented displays.

Thus, the invention provides displays which are far superior in many ways to current segmented displays.

Further objectives and advantages of the invention will become apparent from a consideration of the ensuing description and drawings.

BRIEF DESCRIPTION OF DRAWINGS

Some embodiments of the invention will now be described by way of example only and with reference to the accompanying drawings, in which.

DETAILED DESCRIPTION OF EXEMPLARY EMBODIMENTS

Figure 1:
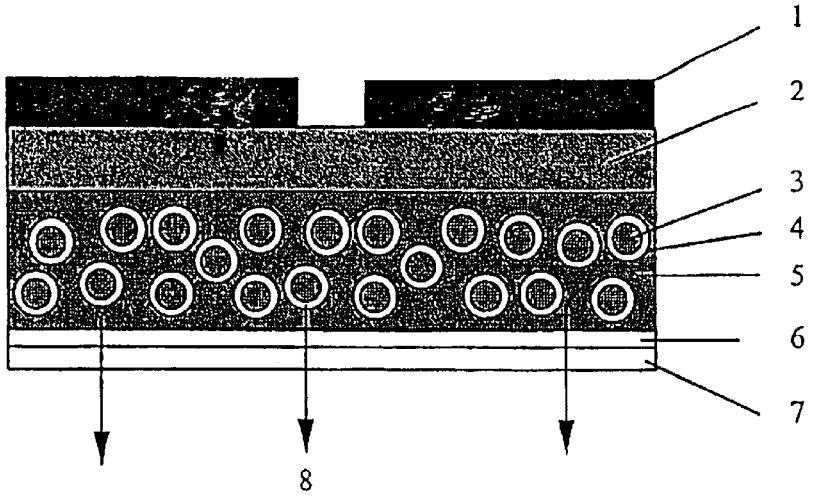
FIG. 1 is a schematic representation of a prior tar electroluminescent lamp.

FIG. 1 shows a typical prior art EL lamp. The essential elements of the lamp are electroluminescent particles 3, such as phosphor, which are held between two electrodes 1, 6, one of which is a transparent electrode 6, often referred to as ITO. The particles 3 may be encapsulated in glass or ITO beads 4 and held in a dielectric matrix 5. A further layer of dielectric 2 may be provided in order to avoid short circuiting problems and the whole lamp is laid out on a substrate 7 of some sort, typically glass or plastics. When an electric field is present between the two electrodes 1, 6, the EL lamp emits light 8.

In the following, phosphor is used as an example of an electroluminescent material. The person skilled in the art will appreciate that many other substances may be used for the same purpose without departing from the invention.

Also, in the following, the invention is described according to two particular embodiments. Given the teaching of this document, the person skilled in the art would think of a large number of alternative embodiments which are within the scope of the invention.

Figure 2:
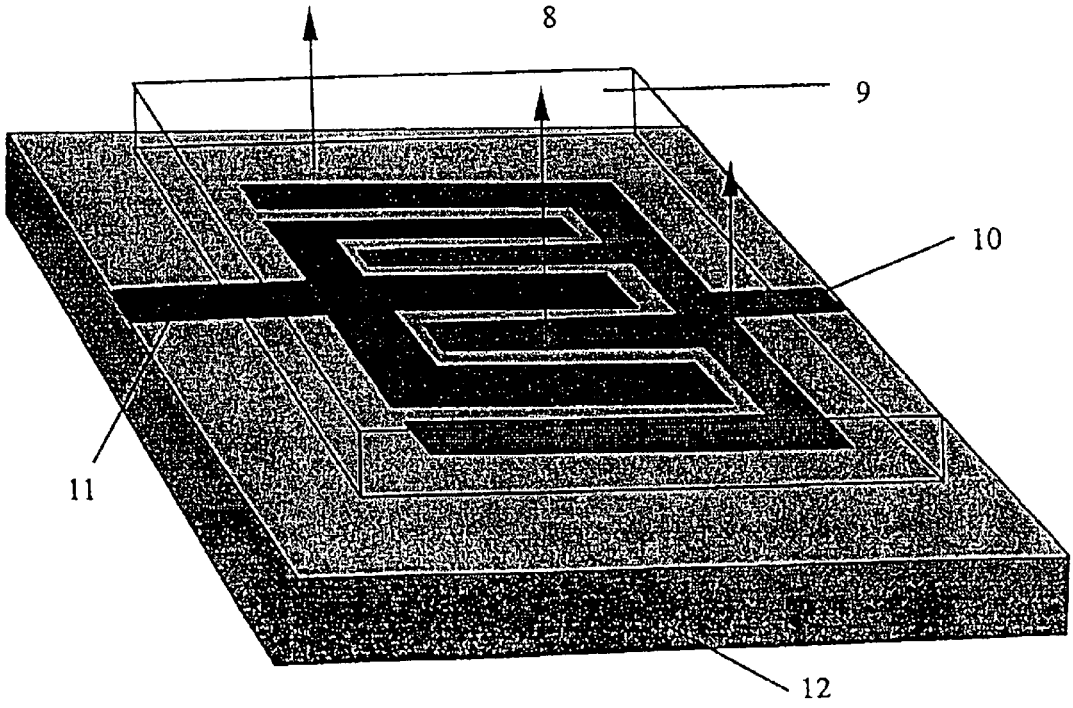
FIG. 2 is a schematic representation of an electroluminescent lamp according to a first embodiment of the invention.

In a first embodiment of the invention, instead of creating the electric field between two planar electrodes as in the prior art (see FIG. 1), the electric field is generated laterally across a single plane between adjacent electrodes applied to a base substrate (see FIG. 2). These adjacent electrodes may, for instance, be interdigitated as shown in FIG. 2 or they may be formed in another shape, as determined by the particular application.

FIG. 2 shows an electroluminescent illuminating means according to a first embodiment of the invention. An electroluminescent substance 9 such as a phosphor (powder film) layer or a phosphor (powder film) layer together with a dielectric sandwich layer lies above a pattern of two electrodes 10, 11 which are interdigitated and which, in turn, lie on a base substrate 12. When appropriate electric signals are applied to the two electrodes 10, 11, the electroluminescent substance emits light 8.

An electroluminescent illuminating means according to the first embodiment of the invention may be produced in either a two or a three stage process:

In the two stage process, both of the electrodes 10, 11 are created simultaneously on a base substrate 12 in the same operation in a first stage (e.g. by screen printing, electroplating, sputtering or etch removal of a continuous coating), and in a second stage, the phosphor layer 9 is applied over the electrode pattern (by screen printing or a similar technique).

In the three stage process, the layer of electrodes and the phosphor layer are separated by a separately applied dielectric layer.

In either case, light created in the phosphor layer is emitted directly from/through the phosphor layer.

Using either two stage or three stage production methods, when compared to the current manufacturing process, the following benefits are realised:

The device may be applied to a wide range of substrates (e.g. plastic, glass, wood, paper, ceramic etc.)

The device may be applied to the surface of a printed circuit board (PCB). In this case, the surface electrode pattern is created in copper (Cu) at the same time, and by the same etching process that is used to create the surface tracks of the PCB itself. The phosphor (or phosphor/dielectric sandwich) is then applied directly to the surface of the PCB.

There is no need for an ITO layer, reducing the cost of the device and the complexity of structure and manufacture.

Application of both electrodes at the same time and by the same process makes it possible to manufacture higher resolution devices without registration problems.

More conductive materials can be used for the electrodes (e.g. copper, silver, gold etc.) thus reducing the current densities needed for the acceptable functioning of the device.

Figure 3:
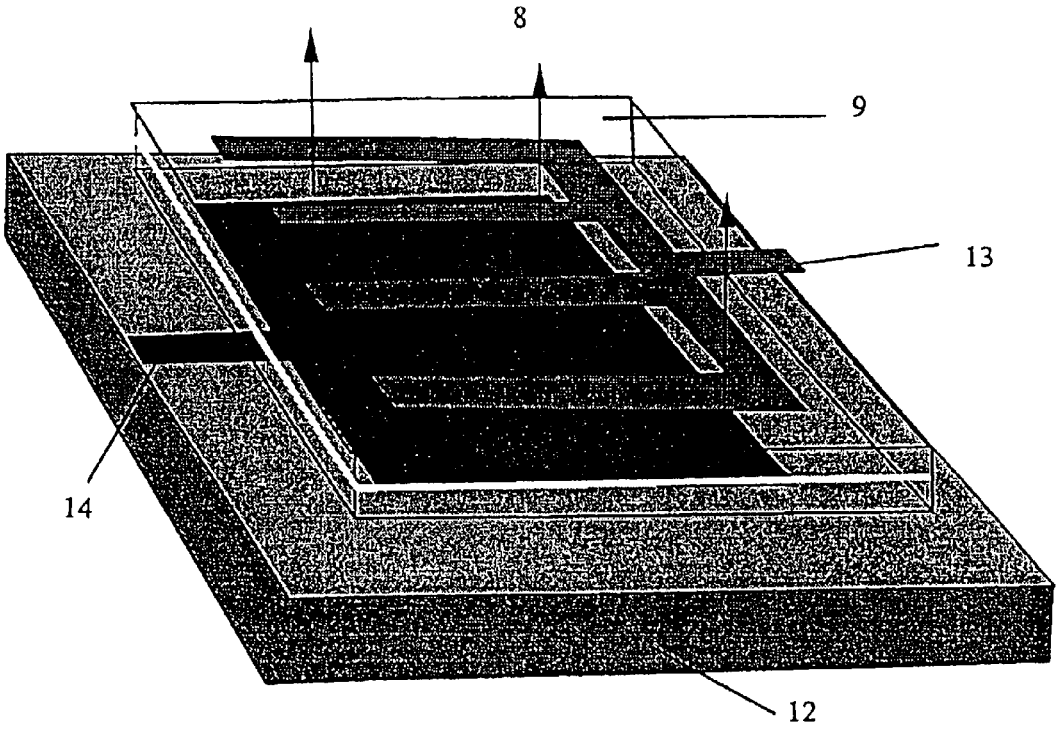
FIG. 3 is a schematic representation of an electroluminescent lamp according to a second embodiment of the invention.

In a second embodiment of the invention, instead of creating the electric field between two full area planar electrodes (see FIG. 1) and allowing the light to escape through the transparent top electrode 6 the field is generated between two planar electrodes which are formed so as to allow light to escape through gaps created in one (or both) of the electrodes (see FIG. 3).

FIG. 3 shows an electroluminescent illuminating means according to a second embodiment of the invention. An electroluminescent substance 9 such as a phosphor (powder film) layer or a phosphor (powder film) layer together with a dielectric sandwich layer lies above a first electrode 14 which lies on a base substrate 12. A second electrode 13 is formed on top of the electroluminescent substance. The second electrode 13 does not fully cover the electroluminescent substance 9 and when appropriate-electric signals are applied to the two electrodes, the electroluminescent substance 9 emits light 8 'around' the second electrode 13.

An electroluminescent illuminating means according to the second embodiment of the invention may be produced in a four stage process with all the stages using the same production method (i.e. silk screen printing). Alternatively such an illuminating means may be produced on top of a PCB, where the base electrode is formed from part of the PCB structure itself.

In the four stage process, both the electrodes 13, 14 are silk screen printed using silver or graphite loaded inks, so that they sandwich layers of dielectric and phosphor.

Where the PCB forms the base electrode, the device is created by silk screen printing phosphor, dielectric, and the top electrode 13 directly on to the surface of the electrode area of the PCB.

Further, the base electrode could be created using a range of different production methods; sputter coating, electroplating, acid etching, spray coating and offset litho printing, for example.

The top electrode 13 could be applied using a range of different methods; sputtering, electro-plating, spray coating and offset litho printing, for example.

This production method, when compared to the current manufacturing process, realises the following benefits:

The device may be applied to a wide range of substrates (e.g. plastic, glass, wood, paper, ceramic etc.)

The device may be applied to the surface of a printed circuit board (PCB). In this case, the surface electrode pattern is created in copper (Cu) at the same time, and by the same etching process that is used to create the surface tracks of the PCB itself. The phosphor (or phosphor/dielectric sandwich) is then applied directly to the surface of the PCB.

There is no need for an ITO layer, reducing the cost of the device and the complexity of structure and manufacture.

More conductive materials can be used for the electrodes (e.g. copper, silver, gold etc.) thus reducing the current densities needed for the acceptable functioning of the device.

Figure 4:
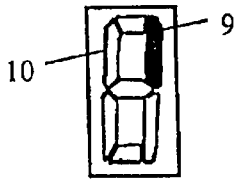
FIG. 4 is a schematic representation of a seven segment display.

According to a further embodiment of the invention a segmented addressable display, such as the seven segment example shown in FIG. 4, is manufactured from individual phosphor EL lamps arranged in such a way as to form the layout of an addressable segmented display. The phosphor EL lamps may be formed by EL illuminating means as described above.

Such a passive addressable display can be made quickly and cheaply.

The benefits from making an addressable segmented display in this way include:

The display has all the desirable characteristics of phosphor EL technology, including, for example, ruggedness, flexibility, low cost, vibration resistance, wide choice of colours, thinness (<0.3 mm), flexibility, self-illumination and wide viewing angle.

The display can be made with high resolution at low cost.

The display can be silk screen printed in a number of ways

The display can be made cheaply and in low or high volumes

The display can be driven passively.

In summary, according to embodiments of the invention an electroluminescent lamp or display comprises a first electrode 11 on a substrate 12 interdigitated with a second electrode 10 on the same substrate 12. A layer of electroluminescent material 9 is provided over the electrodes 10, 11. The arrangement has the advantage that light 8 from the electroluminescent material does not need to pass through either of the electrodes 10, 11. The substrate 12 may be a printed circuit board. In an alternative embodiment the second electrode is provided over the layer 9 of electroluminescent material and gaps are provided in the electrode for the emission of light. The electroluminescent lamps may be used to form a seven segment display.

What is claimed is:

1. An electroluminescent illuminating means comprising:

an electroluminescent substance having at least one surface from which light emission is intended; and a plurality of electrodes positioned substantially parallel to said surface(s) of the electroluminescent substance from which light emission is intended so as to cause, in use an appropriate field of radiation in the electroluminescent substance, characterized in that at least one of said surfaces of the electroluminescent substance from which light emission is intended is at least partially not covered by any of the plurality of electrodes whereby intended light emission does not need to pass through the material of an electrode in order for the electroluminescent illuminating means to function as desired.

2. The electroluminescent illuminating means according to claim 1 wherein said plurality of electrodes are applied on a single side of the electroluminescent substance.

3. The electroluminescent illuminating means according to claim 2 wherein the single side of the electroluminescent substance on which the plurality of electrodes is attached opposite to the surface of the electroluminescent substance from which light emission is intended.

4. The electroluminescent illuminating means according to claim 2 wherein the electrodes form a pattern in which gaps are left between electrodes whereby light emission occurs due to particular parts of the electroluminescent substance which are in close proximity to said gaps.

5. The electroluminescent illuminating means according to claim 1 wherein the electrodes are formed with finger-like projections and neighbouring electrodes are interdigitated.

6. The electroluminescent illuminating means according to claim 1 wherein at least one of said plurality of electrodes is formed on the surface of a printed circuit board.

7. The electroluminescent illuminating means according to claim 1 which is mounted on a substrate selected from the group consisting of plastic and glass and wood and paper and ceramic.

8. The electroluminescent illuminating means according to claim 1 wherein at least one of said electrodes is formed from a material selected from the group consisting of copper and silver and gold.

* * * * *